US011448078B2

(12) United States Patent
White, III et al.

(10) Patent No.: US 11,448,078 B2
(45) Date of Patent: Sep. 20, 2022

(54) SPRING LOADED AIRFOIL VANE

(71) Applicant: Raytheon Technologies Corporation, Farmington, CT (US)

(72) Inventors: Robert White, III, Meriden, CT (US); Amy M. Sunnarborg, Jupiter, FL (US)

(73) Assignee: Raytheon Technologies Corporation, Farmington, CT (US)

( * ) Notice: Subject to any disclaimer, the term of this patent is extended or adjusted under 35 U.S.C. 154(b) by 120 days.

(21) Appl. No.: 16/856,742

(22) Filed: Apr. 23, 2020

(65) Prior Publication Data

US 2021/0332710 A1 Oct. 28, 2021

(51) Int. Cl.
*F01D 9/02* (2006.01)
*F01D 25/00* (2006.01)

(52) U.S. Cl.
CPC ..... *F01D 9/02* (2013.01); *F01D 25/00* (2013.01); *F05D 2240/12* (2013.01)

(58) Field of Classification Search
CPC ..... F01D 9/02; F01D 25/00; F05D 2240/12
See application file for complete search history.

(56) References Cited

U.S. PATENT DOCUMENTS 3,767,322 A 10/1973 Durgin et al.
3,992,127 A * 11/1976 Booher, Jr. ..... F01D 9/042 415/136
4,053,257 A * 10/1977 Rahaim ..... F01D 5/284 415/209.4
10,329,930 B2 * 6/2019 Roussille ..... F01D 25/246
2005/0061005 A1 * 3/2005 Lepretre ..... F01D 11/005 60/800
2007/0098546 A1 * 5/2007 Cairo ..... F01D 11/005 415/170.1
2008/0279679 A1 11/2008 Morrison
2009/0053050 A1 * 2/2009 Bruce ..... F01D 25/246 415/200
2018/0202659 A1 7/2018 Stieg et al.
2019/0010822 A1 * 1/2019 McCaffrey ..... F01D 11/18
2019/0360395 A1 * 11/2019 Cupini ..... F01D 9/065
2020/0248564 A1 * 8/2020 Whittle ..... F01D 9/041
2020/0362709 A1 * 11/2020 Whittle ..... F01D 5/189
2020/0378308 A1 * 12/2020 Slaney ..... F01D 11/005
2020/0408100 A1 * 12/2020 Whittle ..... F01D 25/005

FOREIGN PATENT DOCUMENTS

DE 102008044450 2/2009
EP 1783328 5/2007
EP 3744964 12/2020

OTHER PUBLICATIONS

European Search Report for European Patent Application No. 21169354.4 dated Aug. 12, 2021.

* cited by examiner

*Primary Examiner* — Aaron R Eastman
(74) *Attorney, Agent, or Firm* — Carlson, Gaskey & Olds, P.C.

(57) ABSTRACT

A pin assembly according to an exemplary embodiment of this disclosure, among other possible things includes a spring housing, a spring situated in the spring housing, a pin having a first end configured to be received in the spring housing and to engage the spring, and a boot configured to receive a second end of the pin. The boot is configured to span a gap between first and second adjacent components and configured to transfer a spring force from the spring to the first and second adjacent components. A vane assembly and a method of assembling a vane assembly are also disclosed.

17 Claims, 4 Drawing Sheets

SPRING LOADED AIRFOIL VANE

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Airfoils in the turbine section are typically formed of a superalloy and may include thermal barrier coatings to extend temperature resistance. Ceramic matrix composite ("CMC") materials are also being considered for airfoils. Among other attractive properties, CMCs have high temperature resistance and oxidation resistance. Despite these attributes, however, there are unique challenges to implementing CMCs in airfoils.

SUMMARY

A pin assembly according to an exemplary embodiment of this disclosure, among other possible things includes a spring housing, a spring situated in the spring housing, a pin having a first end configured to be received in the spring housing and to engage the spring, and a boot configured to receive a second end of the pin. The boot is configured to span a gap between first and second adjacent components and configured to transfer a spring force from the spring to the first and second adjacent components.

In a further examples of the foregoing, the pin assembly further comprises a compression structure configured to compress the spring against the spring housing.

In a further example of any of the foregoing, the compression structure is a plunger.

In a further example of any of the foregoing, the compression structure is a spring plate.

In a further example of any of the foregoing, the pin is configured to engage the spring housing to locate the pin with respect to the spring housing.

In a further example of any of the foregoing, the pin includes a neck, and the neck is configured to engage a notch in the spring housing.

In a further example of any of the foregoing, the pin has a flange configured to engage the spring housing.

In a further example of any of the foregoing, the pin assembly further comprises a seal, the seal having an opening configured to receive the second end of the pin.

In a further example of any of the foregoing, the seal has first and second legs. The first leg has the opening configured to receive the second end of the pin and the second leg is configured to be sandwiched between the boot and the first and second adjacent components across the gap between the first and second adjacent components.

An airfoil assembly according to an exemplary embodiment of this disclosure, among other possible things includes first and second vanes arranged adjacent to one another with a gap therebetween, an annular support structure arranged radially outward from the vanes, a spring housing fixed to the annular support structure, a spring situated in the spring housing, a pin having a first end configured to be received in the spring housing and to engage the spring, and a boot spanning the gap, the boot configured to receive a second end of the pin and configured to transfer a spring force from the spring to the first and second vanes.

In a further example of any of the foregoing, the spring housing is received in an opening in the annular support structure.

In a further example of any of the foregoing, the airfoil assembly further comprises a spring plate secured to the spring housing such that the spring plate covers an open end of the spring housing and compresses the spring.

In a further example of any of the foregoing the pin includes a flange configured to engage the spring housing to locate the pin with respect to the spring housing.

In a further example of any of the foregoing the spring housing includes a flange, and wherein the spring housing is secured to the annular support structure via the flange.

In a further example of any of the foregoing, the airfoil assembly further comprises a plunger compressing the spring, wherein the plunger extends through an opening in the annular support structure.

In a further example of any of the foregoing, the airfoil assembly further comprises a seal, the seal having an opening configured to receive the second end of the pin.

In a further example of any of the foregoing, the seal has first and second legs, the first leg having the opening configured to receive the second end of the pin and the second leg configured to be sandwiched between the boot and the first and second adjacent vanes across a gap between the first and second adjacent vanes.

In a further example of any of the foregoing, the first and second vanes are ceramic, and further comprising a spar piece received in a hollow airfoil section of each of the first and second vanes wherein the spar piece is metallic.

A method of assembling a vane assembly according to an exemplary embodiment of this disclosure, among other possible things includes situating a boot across a gap between adjacent first and second vanes, inserting a pin through a spring housing such that a first end of the pin is received in the boot, inserting a spring into the spring housing such that the spring engages a second end of the pin; compressing the spring such that the spring force is transferred to the first and second vanes via the boot.

In a further example of any of the foregoing, the method of assembling a vane assembly further comprises inserting the boot into an opening of a seal, and situating the boot and seal across the gap prior to inserting the pin.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
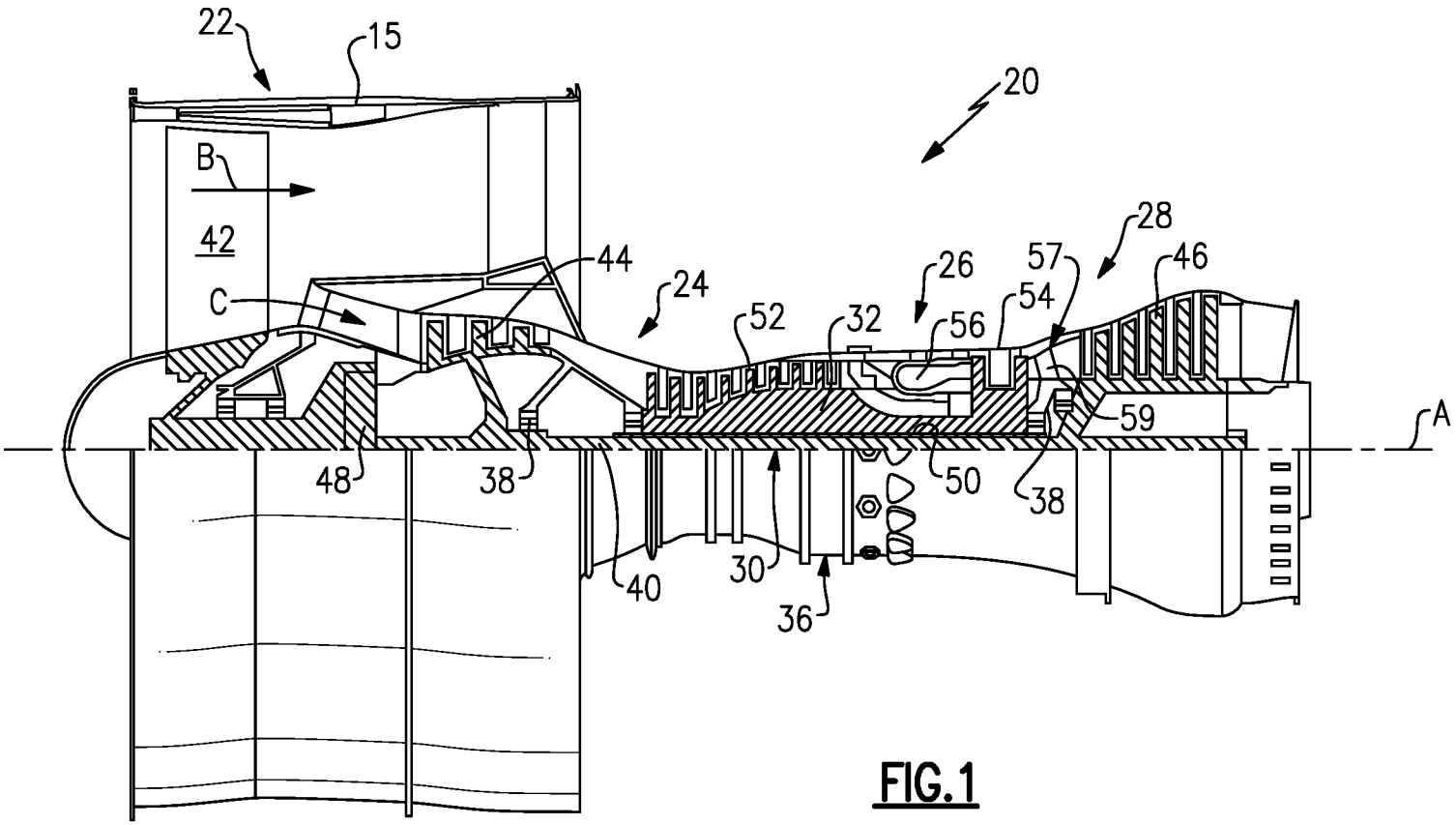
FIG. 1 schematically shows an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. Terms such as "axial," "radial," "circumferential," and variations of these terms are made with reference to the engine central axis A. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFCT')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram °R)/(518.7°R)]^0.5. The "Low corrected fan tip speed" as disclosed herein according to one non-limiting embodiment is less than about 1150 ft/second (350.5 meters/second).

Figure 2:
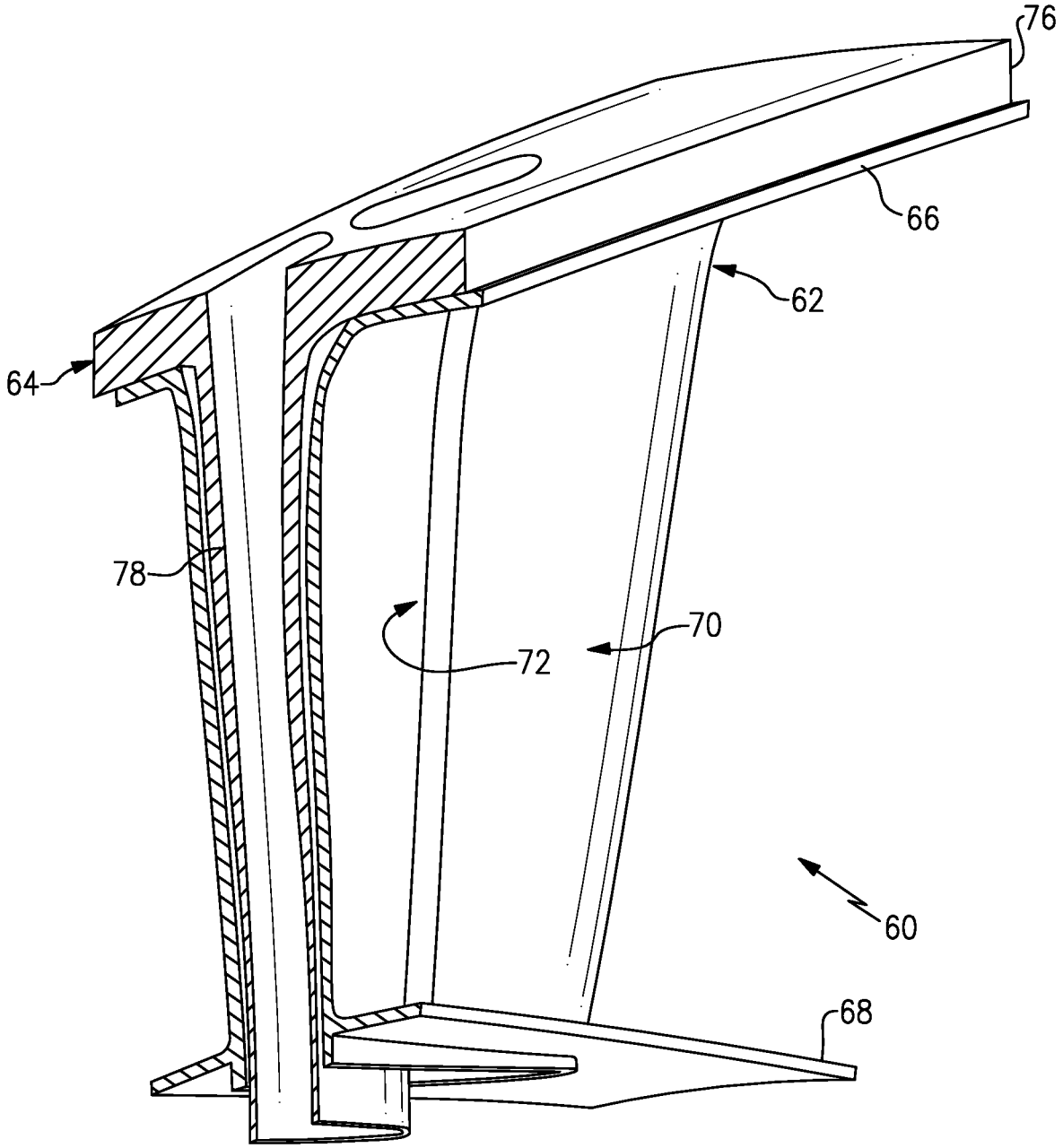
FIG. 2 schematically shows an airfoil vane assembly for the gas turbine engine of FIG. 1.

FIG. 2 illustrates a sectioned view of a representative vane 60 from the turbine section 28 of the engine 20, although the examples herein may also be applied to vanes in the compressor section 24. A plurality of vanes 60 are situated in a circumferential row about the engine central axis A. The vane 60 is comprised of a vane piece 62 and a spar piece 64. The vane piece 62 includes several sections, including first (radially outer) and second (radially inner) platforms 66/68 and a hollow airfoil section 70 that joins the first and second platforms 66/68. The airfoil section 70 includes at least one internal passage 72. The terminology "first" and "second" as used herein is to differentiate that there are two architecturally distinct components or features. It is to be further understood that the terms "first" and "second" are interchangeable in the embodiments herein in that a first component or feature could alternatively be termed as the second component or feature, and vice versa.

The vane piece 62 may be formed of a metallic material, such as a nickel- or cobalt-based superalloy, but more typically will be formed of a ceramic. The ceramic may be a monolithic ceramic or a ceramic matrix composite ("CMC"). Example ceramic materials may include, but are not limited to, silicon-containing ceramics. The silicon-containing ceramic may be, but is not limited to, silicon carbide (SiC) or silicon nitride ($Si_3N_4$). An example CMC may be a SiC/SiC CMC in which SiC fibers are disposed within a SiC matrix. The CMC may be comprised of fiber plies that are arranged in a stacked configuration and formed to the desired geometry of the vane piece 62. For instance, the fiber plies may be layers or tapes that are laid-up one on top of the other to form the stacked configuration. The fiber plies may be woven or unidirectional, for example. In one example, at least a portion of the fiber plies may be continuous through the first platform 66, the airfoil section 70, and the second platform 68. In this regard, the vane piece 62 may be continuous in that the fiber plies are uninterrupted through the first platform 66, the airfoil section 70, and the second platform 68. In alternate examples, the vane piece 62 may be discontinuous such that the first platform 66, the airfoil section 70, and/or the second platform 68 are individual sub-pieces that are attached to the other sections of the vane piece 62 in a joint.

The spar piece 64 defines a spar platform 76 and a (hollow) spar 78 that extends from the spar platform 76 into the hollow airfoil section 70. For example, the spar piece 64 is formed of a metallic material, such as a nickel- or cobalt-based superalloy, and is a single, monolithic piece.

Figure 3:
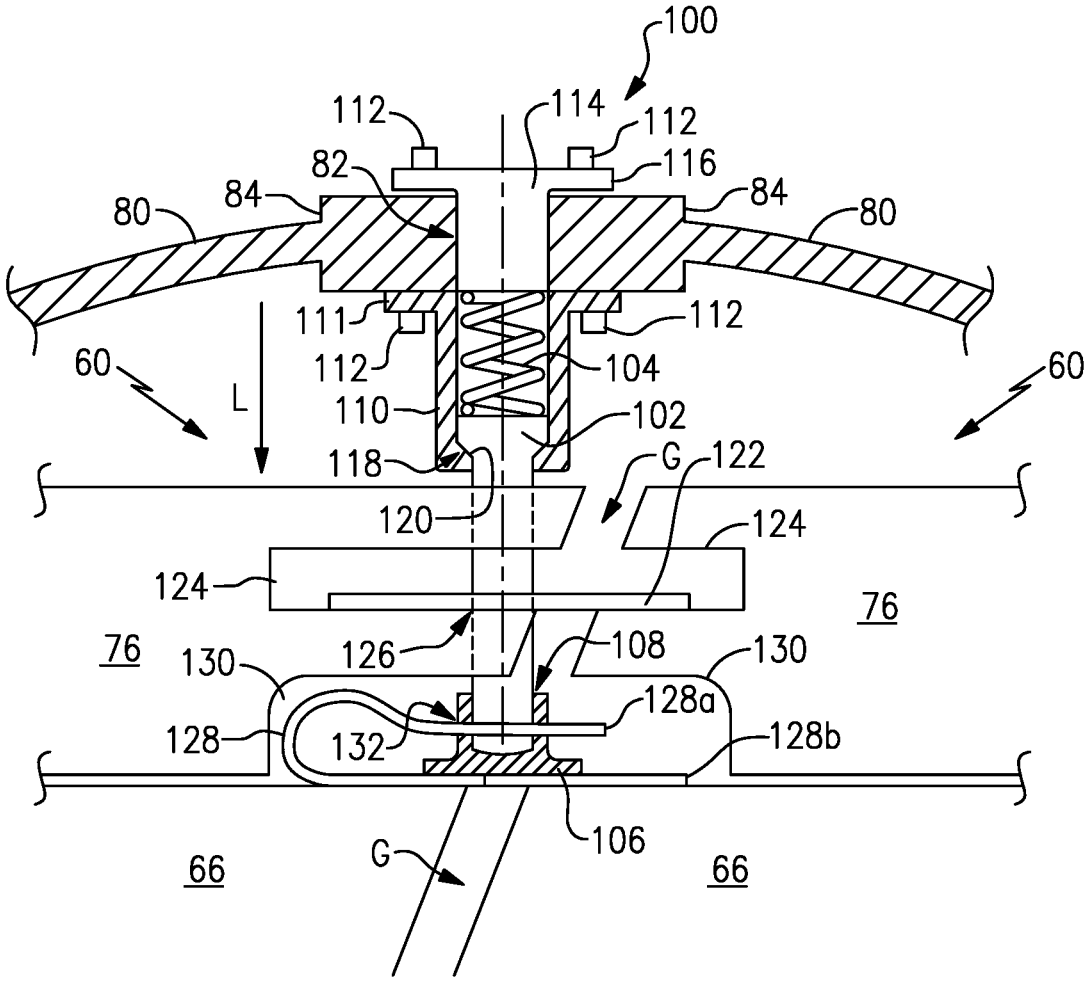
FIG. 3 schematically shows a detail view of an example radially outer end of the airfoil vane assembly of FIG. 2.

Referring now to FIG. 3, a detail view of a radially outer end of adjacent vanes 60 is shown. Though the example structures discussed herein are shown at the radially outer end of vanes 60, it should be understood that the present disclosure could be used near the radially inner end of vanes 60 in some circumstances. Radially outward from the vanes 60 is an annular support structure 80. Between adjacent vanes 60 is a gap G. The gap G is sealed to diminish leakage of air from radially outer areas of the engine and prevent ingestion of flow-path gas (e.g., from core flow path C, FIG. 1) into sensitive compartments of the vane assembly 20, which will be discussed in more detail below. A pin assembly 100 applies a load L to the vanes 60 and seal(s) in a radially inward direction with respect to the engine axis A. The pin assembly 100 thus supports the vanes 60 during assembly and staging of the turbine section 28/compressor section 24 as well as during engine 20 operation and start-up/shut-down. Supporting the vanes 60 in this way can improve the engagement and/or alignment of other adjacent structures within the engine 20 such as the seal(s). Also, when the vanes 60 are loaded with load L, the seal(s) are located and biased in a sealing manner so that the seal(s) are ready to a sealing function upon operation of the engine 20. Still, the spring 104 allows the vanes 60 some radial movement during operation of the engine 20. The spring 104 thus absorbs loads experienced by the vanes 60 which reduces the likelihood of damage to the vanes 60. For instance, the spring 104 could assist in resisting abrupt aero/g-loads.

The pin assembly 100 includes a pin 102, a spring 104, and a boot 106. The boot 106 abuts the outer platforms 66 of the adjacent vanes 60 and spans the gap G in the example of FIG. 3, though in other examples the boot 106 may be placed at another location along the length of the platform 66. Furthermore, though only one pin assembly 100 is shown in FIG. 3, it should be understood that multiple spring assemblies 100 could be placed along the axial and/or radial lengths of the of the platform 66.

The boot 106 is configured to receive an inner end of the pin 102 in an opening 108. The spring force of spring 104 applies the load L to an outer end of the pin 102 which transfers the load to the vanes 60 via the boot 106. The boot 106 has a geometry which delivers the load, L, over an area that spans both sides of the gap G. where the platforms 66 are relatively flat, the boot 106 could have a relatively flat geometry. However, in some other examples, the platform 66 may have a curvature to it, and the boot 106 could have a geometry that tracks the curvature (e.g., has a spherical or conical nature) to provide improved contact and load L transmission to the platforms 66.

Moreover, in some examples, the boot 106 may be omitted entirely, and the pin 102 may have a geometry that enables it to engage the platform 66 and/or the spar platform 76. For example, the pin 102 could include a tongue feature that is configured to engage a groove feature on the platform 66 and/or the platform 76.

The spring 104 can be any type of spring such as a helical spring, wave spring, or another type of spring that would be known in the art. The spring 104 and/or the radial dimension of the spring housing 110 are selected so that when the pin 102 is installed in the pin assembly 100, the spring 104 is compressed and applies the load L to the vanes 60 as discussed above.

In the example of FIG. 3, the spring 104 is situated in a spring housing 110 that is between the support structure 80 and the spar platform 76. The spring housing 110 has a flange 111 that is secured to the support structure 80 via one or more fasteners 112, such as screws or threaded bolts; in other examples, the spring housing 110 may be welded/brazed to the support structure 80 or a cast feature in the engine 20 casing. A compression structure, which in this example is a plunger 114, extends through an opening 82 in the support structure 80 and compresses the spring 104 against the radially outer end of the pin 102. In some examples, the opening 82 can be formed in a section of the support structure 80 which has an enlarged radial thickness defined by squared bosses 84. The square bosses 84 provide mating surfaces for mating with the flange 116 of the plunger 114 (discussed below) and/or the flange 111 of the spring housing 110. However, it should be understood that rounded bosses could be used in place of square bosses 84.

In this example, the plunger 114 has a flange 116 that has a larger dimension than the opening 82 so that the flange 116 catches an outer surface of the support structure 82 to maintain a steady compressive force on the spring 104. The flange 116 can be secured to the support structure 80 by one or more fasteners 112. In some examples, the compression of the spring 104 can be modified by tightening or loosening the fasteners 112.

In this example, the pin 102 has a neck 118 near its radially outer end which is configured to engage a notch 120 of the spring housing 110. The neck 118/notch 120 locate the pin radially and axially to reduce wobbling of the pin 102.

One or more seals seal the gap G. In the example of FIG. 3, there are two seals, though it should be understood that other sealing arrangements are contemplated. A first seal 122 is situated in pockets 124 formed in edges of adjacent spar platforms 76. The seal 122 could be a feather seal or another type of seal. In the example shown in FIG. 3, the seal 122 includes an opening 126 which receives the pin 102 therethrough. However, in other examples, the seal 122 could be situated adjacent the pin 102 so that the pin 102 passes through the pocket 124 but not the seal 122 itself. In yet another example, the vane and spar platforms 66/74 may be ship-lapped, that is pitched relative to one another, so that the pin 102 may avoid passing through the pocket 124/opening 126 all-together.

A second seal 128 is arranged between the outer platforms 66 of the vane pieces 62 and the spar platforms 76. In this example, the seal 128 is situated in pockets 130 formed in the radially inner face of the spar platforms 76, though in another example the pockets could be formed in the radially outer face of the vane platforms 66. The seal 128 in the example of FIG. 3 is a mate face seal, though other seals could be used. The mate face seal 128 includes first and second legs 128*a*, 128*b* connected at a bend. The first (radially outer) leg 128*a* includes an opening 132 that receives the boot 106 and pin 102 therethrough. The second (radially inner) leg 128*b* is arranged between the boot 106 and the vane platforms 66, across the gap G.

Figure 4:
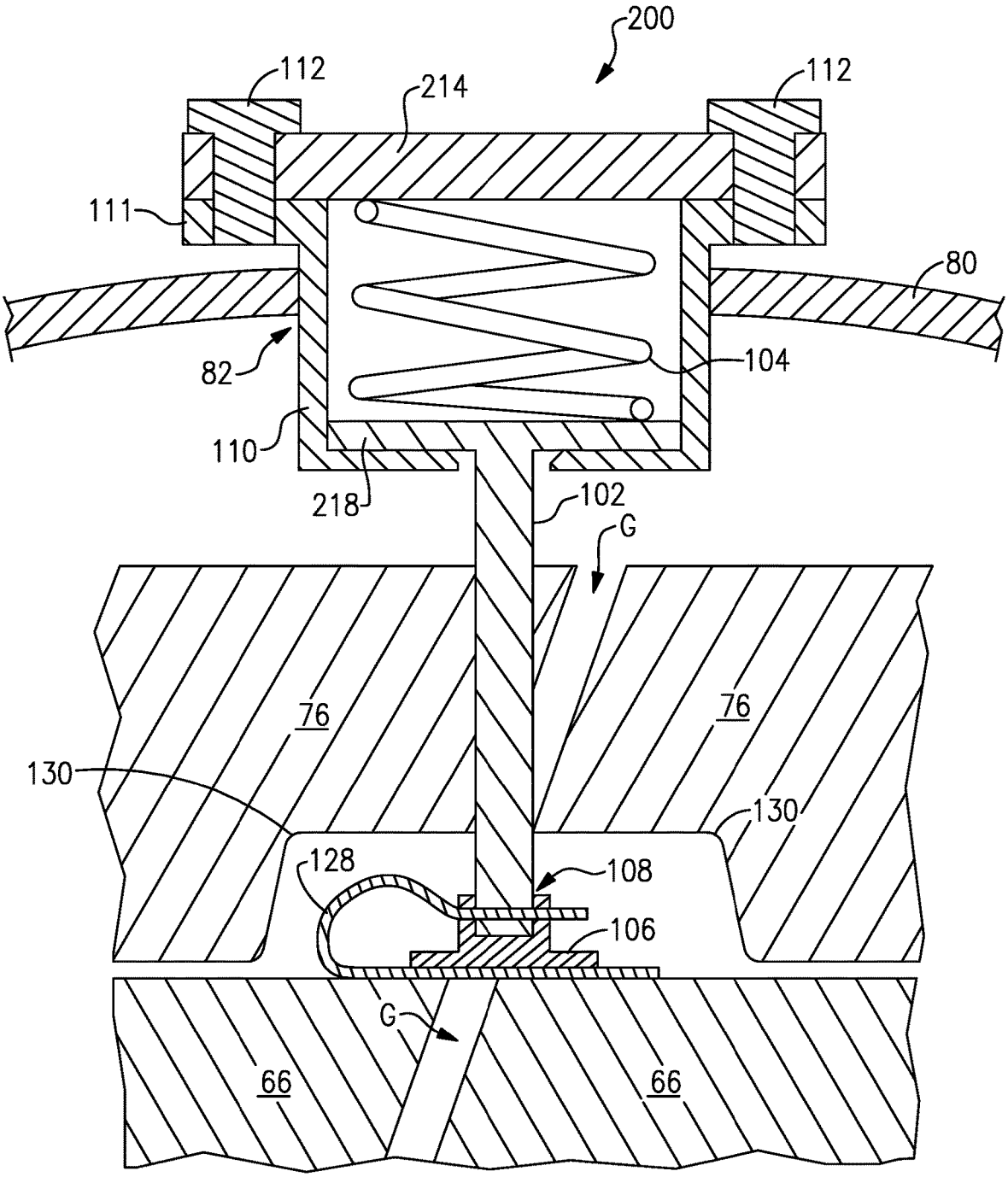
FIG. 4 schematically shows a detail view another example radially outer end of the airfoil vane assembly of FIG. 2.

FIG. 4 shows another example pin assembly 200. This example also includes the pin 102, spring 104, boot 106, and spring housing 110. In the example, the spring housing is situated in the opening 82 in the support structure 80, and is secured to the support structure 80 by welding or press-fitting (toleranced, cryogenically, or otherwise), for example. Though in FIG. 4 the opening 82 extends uniformly through the entire radial dimension of the support structure 80, in another example, the opening 82 could be in the form of a counterbore that receives the spring housing 110.

Rather than a plunger 114, this example includes a spring plate 214 which covers an open end of the spring housing 110 and compresses the spring 104. The spring plate 214 is secured to the flange 111 of the spring housing 110 by fasteners 112.

In the example of FIG. 4, the pin 102 includes a flange 218 rather that a neck 118. The flange 218 of the pin 102 engages the spring housing 110 to locate the pin 102 as discussed above.

In the example of FIG. 4, only the mate face seal 128 is shown, though as discussed above, it should be understood that other seals could be used in addition to or instead of the mate face seal 128.

Though FIGS. 3 and 4 show only one pin assembly 100/200, in some examples more than one pin assembly 100/200 could be used. For instance, first and second pin assemblies 100/200 could be used at opposite axial faces of the platforms 66/76. In this example, the seal(s) 122/128 are adapted to receive pins 102 of both pin assemblies 100/200. The pins 102 cooperate to secure the seal(s) 122/128 from radial/axial movement and from rotation about the pins 102.

The pin assemblies 100/200 of FIGS. 3 and 4 are assembled as follows. The boot 106 is situated adjacent the vane platform 66 and is inserted into the opening 130 of the seal 128. The pin 102 is inserted though the spring housing 110 and into the boot 106, thereby securing the seal 128 in place. The spring 104 is inserted into the spring housing 110. The plunger 114/spring plate 214 are secured to the seal housing 110, compressing the seal.

Though the pin assemblies 100/200 are discussed herein in the context of the vane 60, it should be understood that pin assemblies 100/200 could be used in other areas of an engine 20 that would benefit from a biasing load such as load L. For instance, pin assemblies 100/200 could be used to bias seals throughout the engine 20 against their respective sealing surface. One example seal that could incorporate a pin assembly 100/200 is a blade outer air seal (BOAS).

Although the different examples are illustrated as having specific components, the examples of this disclosure are not limited to those particular combinations. It is possible to use some of the components or features from any of the embodiments in combination with features or components from any of the other embodiments.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A pin assembly, comprising:
- a spring housing;
- a spring situated in the spring housing;
- a pin having a first end configured to be received in the spring housing and to engage the spring;
- a boot configured to receive a second end of the pin, wherein the boot is configured to span a gap between first and second adjacent components and configured to transfer a spring force from the spring to the first and second adjacent components; and
- a seal, the seal having an opening configured to receive the second end of the pin.

2. The pin assembly of claim 1, further comprising a compression structure configured to compress the spring against the spring housing.

3. The pin assembly of claim 2, wherein the compression structure is a plunger.

4. The pin assembly of claim 2, wherein the compression structure is a spring plate.

5. The pin assembly of claim 1, wherein the pin is configured to engage the spring housing to locate the pin with respect to the spring housing.

6. The pin assembly of claim 5, wherein the pin includes a neck, and the neck is configured to engage a notch in the spring housing.

7. The pin assembly of claim 5, wherein the pin has a flange configured to engage the spring housing.

8. The pin assembly of claim 1, wherein the seal has first and second legs, the first leg having the opening configured to receive the second end of the pin and the second leg configured to be sandwiched between the boot and the first and second adjacent components across the gap between the first and second adjacent components.

9. An airfoil assembly for a gas turbine engine, comprising:
- first and second vanes arranged adjacent to one another with a gap therebetween;
- an annular support structure arranged radially outward from the vanes;
- a spring housing fixed to the annular support structure;
- a spring situated in the spring housing;
- a pin having a first end configured to be received in the spring housing and to engage the spring;
- a boot spanning the gap, the boot configured to receive a second end of the pin and configured to transfer a spring force from the spring to the first and second vanes; and
- a seal, the seal having an opening configured to receive the second end of the pin.

10. The airfoil assembly of claim 9, wherein the spring housing is received in an opening in the annular support structure.

11. The airfoil assembly of claim 10, further comprising a spring plate secured to the spring housing such that the spring plate covers an open end of the spring housing and compresses the spring.

12. The airfoil assembly of claim 10, wherein the pin includes a flange configured to engage the spring housing to locate the pin with respect to the spring housing.

13. The airfoil assembly of claim 9, wherein the spring housing includes a flange, and wherein the spring housing is secured to the annular support structure via the flange.

14. The airfoil assembly of claim 13, further comprising a plunger compressing the spring, wherein the plunger extends through an opening in the annular support structure.

15. The airfoil assembly of claim 9, wherein the seal has first and second legs, the first leg having the opening configured to receive the second end of the pin and the second leg configured to be sandwiched between the boot and the first and second adjacent vanes across a gap between the first and second adjacent vanes.

16. The airfoil assembly of claim 9, wherein the first and second vanes are ceramic, and further comprising a spar piece received in a hollow airfoil section of each of the first and second vanes wherein the spar piece is metallic.

17. A method of assembling a vane assembly, comprising:

situating a boot across a gap between adjacent first and second vanes;

inserting a pin through a spring housing such that a first end of the pin is received in the boot;

inserting a spring into the spring housing such that the spring engages a second end of the pin;

compressing the spring such that the spring force is transferred to the first and second vanes and inserting the boot into an opening of a seal, and situating the boot and seal across the gap prior to inserting the pin.

* * * * *